United States Patent [19]

Yang

[11] Patent Number: 5,003,439

[45] Date of Patent: Mar. 26, 1991

[54] LOW-VOLTAGE BAR-SHAPE INDICATING LAMP FOR OUTDOOR PURPOSE

[76] Inventor: Tai-Her Yang, 5-1 Taipin St., Si-Hu Town, Dzan-Hwa, Taiwan, R.O.C.

[21] Appl. No.: 376,993

[22] Filed: Jul. 7, 1989

[51] Int. Cl.[5] ..... F21V 17/02

[52] U.S. Cl. ..... 362/153; 362/183; 362/220; 362/250; 362/239; 439/13

[58] Field of Search ..... 362/183, 184, 249, 250, 362/251, 252, 285, 287, 426, 431, 145, 152, 153, 219, 220, 223, 225, 238, 239, 240; 439/13, 419, 425

[56] References Cited

U.S. PATENT DOCUMENTS

| | | | |
|---|---|---|---|
| 4,581,687 | 4/1986 | Nakanishi | 362/252 |
| 4,597,033 | 6/1986 | Meggs et al. | 362/183 |
| 4,607,317 | 8/1986 | Lin | 362/287 |
| 4,763,232 | 8/1988 | Woodside | 362/391 |
| 4,768,139 | 8/1988 | Poppenheimer | 362/431 |
| 4,774,648 | 9/1988 | Kekuk et al. | 362/431 |
| 4,787,015 | 11/1988 | Ching-Hwei | 362/427 |
| 4,835,664 | 5/1989 | Weh | 362/431 |
| 4,843,525 | 6/1989 | Williams | 362/145 |
| 4,870,548 | 9/1989 | Beechy et al. | 362/431 |

*Primary Examiner*—Stephen F. Husar
*Assistant Examiner*—D. M. Cox
*Attorney, Agent, or Firm*—Leonard Bloom

[57] ABSTRACT

The invention relates to low-voltage lamps that have bar-shaped shades that are used outdoors, especially as indicating lights at night. There may be a plurality of shades that are joined together by coupling elements so that the user may select the precise position of the lamp relative to the object being illuminated.

3 Claims, 3 Drawing Sheets

LOW-VOLTAGE BAR-SHAPE INDICATING LAMP FOR OUTDOOR PURPOSE

FIELD OF THE INVENTION

The present invention relates to low-voltage indicating lamps for outdoor purposes and, in particular, to low-voltage lamps for illuminating a courtyard, so that objects therein can be seen, especially at night.

BACKGROUND OF THE INVENTION

Many suburban residents have a courtyard that includes a yard having flowers and trees planted therein.

The present invention relates to illuminating (indicating) lamps for illuminating the yard, thereby indicating the location of these items for helping (leading) a driver to navigate his car in and out of the courtyard, during the night hours, without running over them. The lamps of the present invention have a bar-shaped shade (indicating structure). The bar-shaped lamp shade of the low-voltage lamp of the present invention can be made so as to be one or more colors of light transmission and is supplied power by a power supply (a low-voltage power source) such as solar cells or rechargeable batteries that can be controlled by manual timing or photoelectric controls in the same manner as the lamp that is disclosed in U.S. Pat. No. 4,645,980 issued to the applicant herein. However, the bar-shaped lamp shade of the present invention is more visible than the point-shaped design disclosed in the '980 patent.

Further, the present invention permits fabrication of the lamp of the present invention with a plurality of shades that are joined together by coupling elements [joint-shaped portion(s)]. This permits the user thereof to select the precise level or positioning of the lamp relative to the ground and/or object being illuminated thereby.

SUMMARY OF THE INVENTION

The bar-shaped structure of the low-voltage lamp of the present invention may be positioned and arranged in any courtyard for illumination, thereby permitting a driver to see and discern the lawn and/or elements thereof, such as a flower bed and sidewalks, and thus is advantageous for helping a driver to avoid running over such elements, especially at night.

DETAILED DESCRIPTION OF PREFERRED EMBODIMENTS

Figure 1:
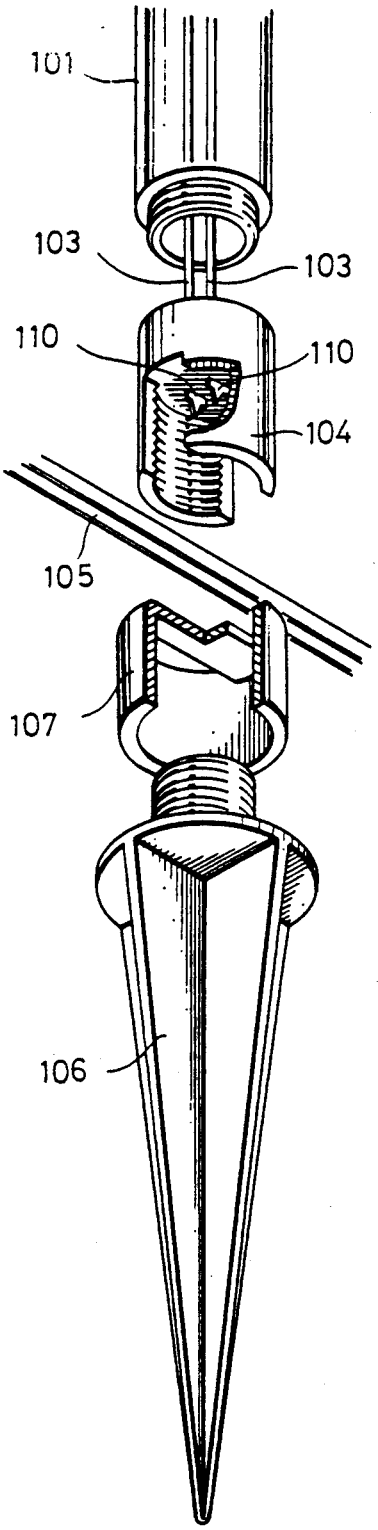
FIG. 1 is a perspective view of the bar-shaped lamp of the present invention with portions thereof broken away therefrom for the sake of clarity.

Referring generally now to the drawings, the present invention relates to a bar-shaped low-voltage indicating (illuminating) lamp provided for being installed within the courtyard and/or garden for aiding a driver to avoid running over the lawn and elements therein by aiding their being viewed, especially at night.

The lamp of the present invention includes at least one light transmissible (transparent) shade section 101. Each of these sections 101 is provided for low-voltage lamps 102 that are located therein and which are connected (electrically) to a low-voltage power source such as a transformer, solar cell or rechargeable battery. This shade 101 is fabricated from transparent, colored or multi-colored materials for advantageously providing more alternatives (choices) for illuminating.

The bar-shaped lamp can also have multiple shades (sections) 101 (a polysectional structure) joined (coupled) by one or more joint coupling elements or coupling elements (universal finding joints) so that the lamp may be adapted and shaped to environmental conditions and providing easier geometric formation or illumination (sight marking) of the courtyard, garden, etc.

The aforesaid bi-sectional or poly-sectional lamp has various couplings (bending joints) which include electrical conductions points (conductive sheets) for aiding in the transmission of electrical power (electricity) from the power source to the bulbs 102 in the individual shades (sections ) 101.

The aforesaid bar-shaped indicating lamp can have a multi-wing arrow-shaped or pointed stake (plug foot) which aids in disposing (planting) and supporting the lamp in place in the ground of the courtyard.

The said uni-sectional or poly-sectional bar-shaped lamp shade can be made into parallel or other kind of shape. The shape of the individual sections may be circular, rectangular, polygonal or any other desired suitable shape.

The said bar-shaped indicating lamp may have one portion thereof which is provided for housing a low-voltage electrical power cord that is located therein.

The aforesaid low-voltage power source (supply) can be controlled by photoelectrical, timing, or manual control as described in the '980 patent.

Figure 2:
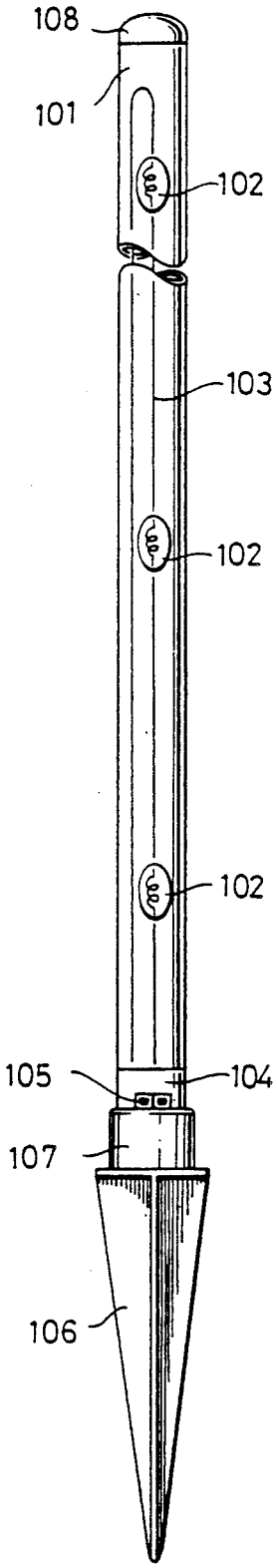
FIG. 2 is a side view, in cross-section, illustrating electrical wiring of the lamp of FIG. 1.
Figure 3:
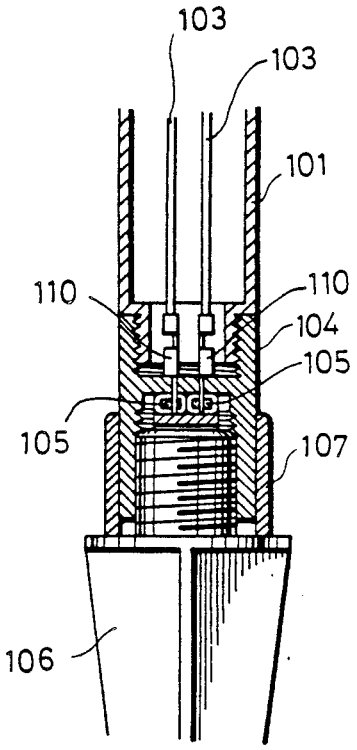
FIG. 3 is a cross-section view of a portion of the lamp of FIG. 2.

As shown in FIGS. 1–3, the bar-shaped lamp housing (shade) 101 is a hollow tube (or sleeve) made of light transmissible (transparent) plastic materials. These shades 101 may be either transparent, unicolored or multicolored. The shade 101 includes at least one low-voltage light bulb (or light source) 102 disposed therein. The bulbs 102 may be arranged in series or in parallel. These bulbs 102 are electrically connected to one another by electrical circuit wires (power cord) 103.

A coupling element (joint seat) 104 including a top end and a lower end is provided for removably joining (coupling), by mutually engaging threaded portions, the lower most end of the shades 101 to the stake 106. A pair of needle shaped electrical conduction points (bases) 110 are disposed in and carried by the coupling element 104, so as to extend through the coupling element 104 from the top end to the lower end thereof. Both the top and bottom ends of the coupling element 104 are recessed having respective threads (tapped) formed therein, the coupling element 104 further has a pair of diametrically-opposed slots (coupling slots) formed therein extending upwardly from the lower end thereof, each terminating in respective inwardly-oriented notches below the top end thereof.

The lowermost (bottom-most) end of the bottom-most (lowermost) shade 101 has an externally-threaded boss formed thereon. The downwardly-extending externally-threaded boss of the shades 101 is received in the recess in the top end of the coupling element 104, wherein the respective threads thereof matingly engage one another. In this fashion, the coupling element 104 is removably coupled to the said lowermost shade 101 located thereabove.

An electrical power cord 105 is disposed intersecting and extending through the coupling element 104, passing through the respective slots thereof. The power cord 105 as disposed extending between and electrically connected to the low-voltage power source (not shown) and the electrical conduction points 110 at the lower end of the coupling element 104. In this manner, the power cord 105 electrically connects the electrical conduction points 110 to the power source, so that low-voltage electric power is supplied by the power source to the electrical conduction points 110.

Electrical circuit wires (leads) 103 are disposed electrically connected between the conduction points 110 at the upper (top) end of the coupling element 104 and the light bulbs 102 disposed within the shade 101. In this manner, the low-voltage electric power supplied to the points 110 is supplied to the bulbs 102, so that the bulbs 102 may be energized for illuminating the bulbs 102.

A stake or base in the form of a downwardly extending arrow-point type plug foot 106 is provided. The stake 106 may be pushed (inserted) into the ground, whereby the lamp is fixed and supported in place. To this end, the pointed winged arrangement of the stake 106 aids in permitting this insertion.

An upwardly-extending externally-threaded (tapped) boss is formed on the top of the stake 106. This boss is sized and shaped, so as to removably threadably engage and mate with the threads formed in the lower (bottom) end of the coupling element 104. In this fashion, the coupling element 104 is coupled to the stake 106.

A sleeve (joint ring) 107 is provided for limiting the size of the opening of the slots formed in the coupling element 104 when the boss of the stake 106 is threadably engage in the tapped recess (internal top hole) formed in the lower end of the coupling element 104. The sleeve 107 has a top end and a bottom end. The top end has a catch bar extending thereacross. In use, the sleeve 107 is disposed on the top end of the stake 106 surrounding the boss formed thereon. The catch bar passes upwardly through the slots and is received in the notches, with the power cord 105. This allows the cord 105 and the sleeve 107 to be maintained in place.

A decorative or sealed uppermost shade 108 is provided, if desired and/or necessary, such as when the uppermost end of the shade 101 is open. In such case, the shade 108 is disposed over the open end being (if desired) removably secure thereto.

Figure 4:
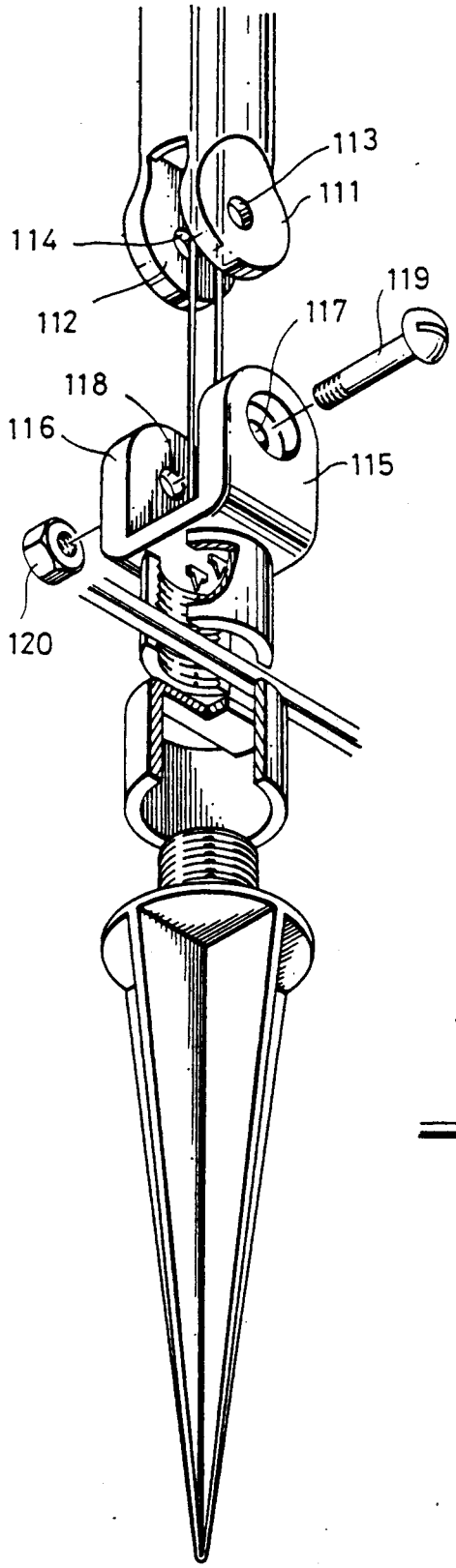
FIG. 4 is a perspective view of a lower end of the bar-shaped lamp of the present invention having a coupling element (a joint) formed therein and with portions thereof broken away therefrom for the sake of clarity.
Figure 5:
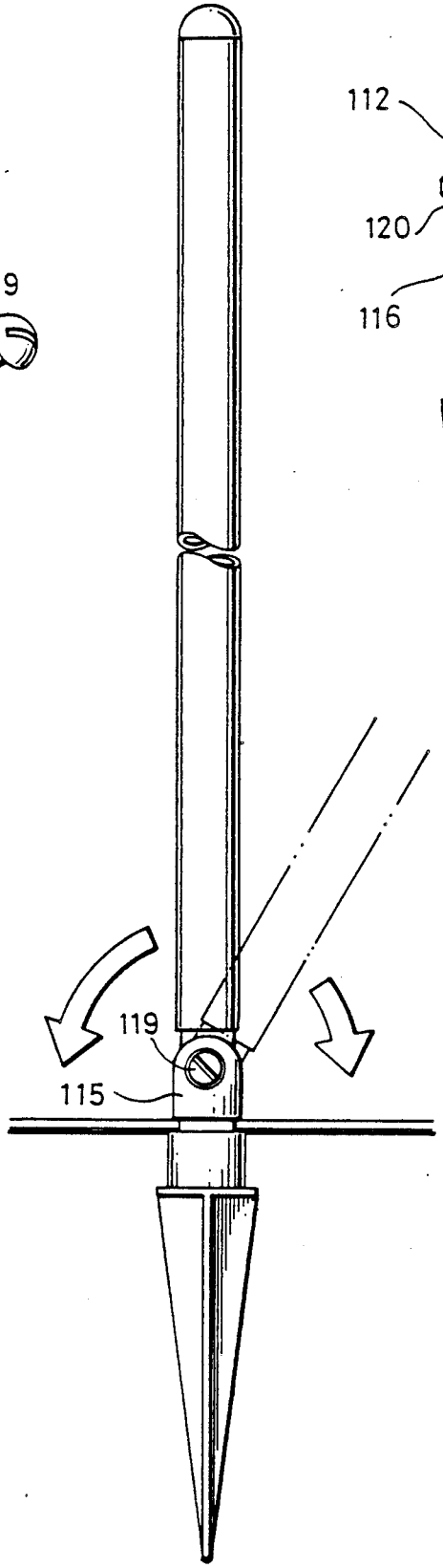
FIG. 5 is a side view showing movement of the shade of FIG. 4 about the coupling element (joint) thereof.
Figure 6:
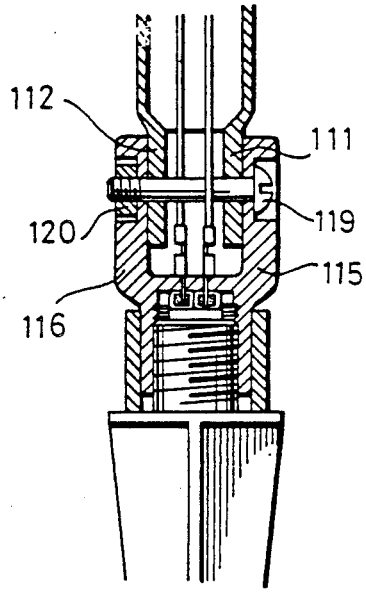
FIG. 6 is a cross-section view of the coupling element (joint) of FIGS. 4 and 5.

Referring now to FIGS. 4–6, the lamp may include a coupling element (joint) between the stake 106 and the lowermost shade 101 that is joined together by a screw and nut arrangement, so that the lamp shade 101 may pivot about the element for the selective positioning thereof.

In this embodiment, the lowermost (bottom-most) end of the shade 101 being open with a pair of diametrically-opposed downwardly-extending lateral wings 111 and 112 formed thereon. The wings 111 and 112 have respective central openings 113 and 114 formed therein. As seen, the openings 113 and 114 are aligned with one another.

The coupling element again includes a top end and a lower (bottom) end for removably joining the wings 111 and 112 of the lowermost end of the shade 101 to the stake 106 via the coupling element 104.

Like the coupling element 104 discussed above with reference to FIGS. 114 3, the coupling element 104 illustrated in FIGS. 4–6 includes a pair of needle-shaped electrical conduction points (bases) 110, the recessed threaded bottom (lower) end and the coupling slots described at length above. The lower (bottom) end of the coupling element 104 cooperates with the power cord 105, the stake 106 and the sleeve 107 in the same manner, as was described at length above.

The top end of the coupling element 104 has a diametrically-opposed pair of upwardly-extending external wings 115 and 116. Each of the wings 115 an 116 have a respective central opening 117 and 118, respectively formed therein. Central openings 117 and 118 are aligned with one another.

When the shade 101 is coupled to the coupling element 104, the wings 111 and 112 are received between the wings 115 and 116 with the openings 113, 114, 117, and 118 aligned with one another. Central screw 119, having a head and an opposite threaded end, is received through the central holes 113, 114, 117, and 118, being secured therein by a nut 120 which may be selectively tightened and loosened. When loosened, the shade 101 may be selectively pivoted about the joint (the screw 119) to a selected position (see FIG. 5). When in the desired position, the nut 120 is then tightened for securing (locking) and maintaining the shade 101 in the desired position.

Figure 7:
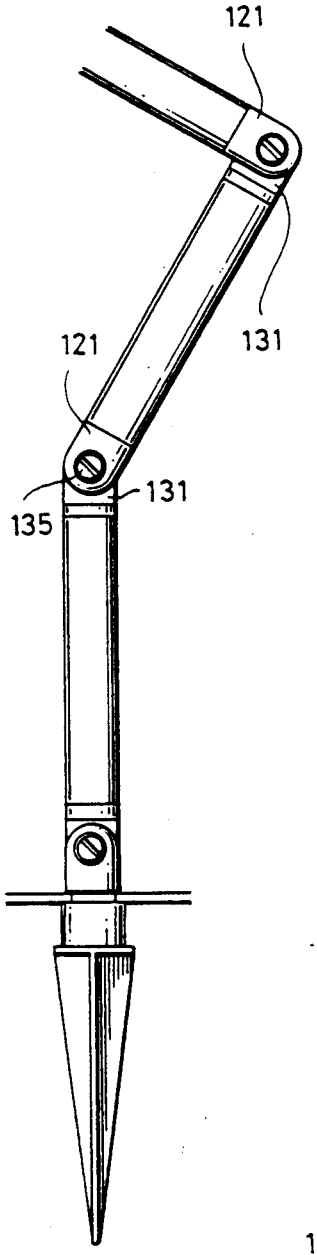
FIG. 7 is a perspective view of a lower end of the lamp of the present invention having multiple joint coupling elements (multiple joints) formed therein.
Figure 8:
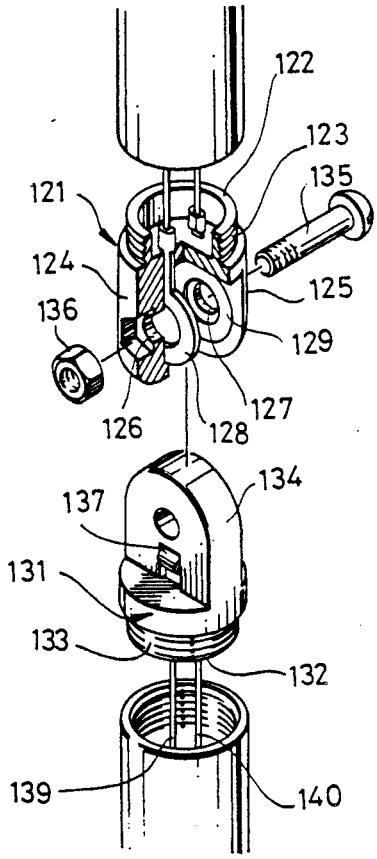
FIG. 8 is an exploded perspective view of one of the joint coupling elements of FIG. 7 with portions thereof broken away therefrom for the sake of clarity.
Figure 9:
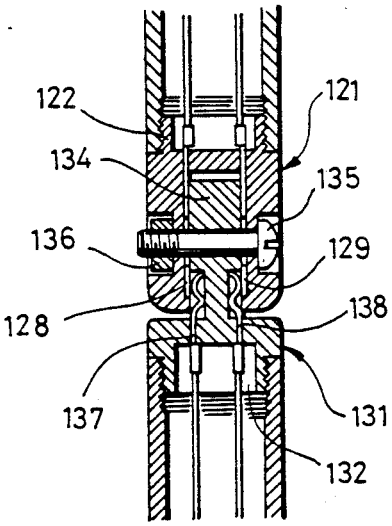
FIG. 9 is a cross-section view of the joint coupling element of FIG. 8 when assembled.

The aforesaid lamp structures can further have multiple joints between various shades 101, as shown in FIGS. 7–9 to provide a lamp having a plurality (at least two) shades, in order to increase the flexibility thereof.

The lamp of FIGS. 7–9 includes the same stake 106 as was described above relative to FIGS. 1–6. The lamp of FIGS. 7–9 further includes the joint including the coupling element 104, sleeve 107, power cord 105 and the lowermost end of the lowermost shade 101, described above relative to FIGS. 4–6.

In this embodiment, the joints located between the adjoining shades 101 of the lamp includes the ends of the shades being internally threaded. Joint coupling elements including the upper element (upper auxiliary connector) 121 and the lower element (lower auxiliary connector) 131.

The upper element 121 is provided having an upper end and a lower end. The upper end of the upper element 121 has an upwardly-extending externally-threaded boss (neck ring) 122 formed thereon (which is threaded at 123). This threaded boss 122 matingly engaged the internally-threaded recess in the lowermost end of the shade 101 located thereabove for being removably secured thereto. The lower end of the upper element 121 has a pair of diametrically-opposed downwardly-extending laternal extension wings 124 and 125 formed thereon. The wings 124 and 125 have respective central holes 126 and 127 formed thereon. Central holes 126 and 127 are aligned with one another. Electrical conduction points 128 and 129 are carried on the internal sides of the wings 124 and 125 of the upper element 121. These points (ring conducting sheets) extend from &he upper to the lower ends of the connector 121. The points 128 and 129 are connected, via wires 103 to the bulbs 102.

The lower element 131 has an upper end and a lower end. The lower end of the lower element 131 has a lower downwardly-extending externally-threaded boss (lower neck ring) 13 formed thereon (threaded at 133). This threaded boss removably matingly engages the internally-threaded recess in the top (upper) end of the shade 101 located therebelow for being removably secured thereto. The upper end of the lower element 131 has an upwardly-extending convex head 134 formed thereon. The head 134 is removably received between the wings 124 and 125 for removably mutually coupling therewith. The convex head 134 has a center hole formed therethrough that is aligned with the central holes 126 and 127. When the joint is assembled, a screw 135, having a head and an opposite threaded end is received through said central-holes, being secured therein by a nut 136, which may be selectively tightened and loosened. When loosened, the shades 101 may be pivoted about the screw 135 of the joint to a selective position. When in the desired position, the nut 136 is then tightened for securing (locking) and maintaining the shade 101 in the desired position and permitting selective adjustment of the angles of the lamp shades 101.

A pair of electrical conduction points (springs) 137 and 138 are carried by the lower element 131 extending from the upper to the lower element 131 extending from the upper to the lower ends thereof. The upper portions of the points (springs) 137 and 138 are resilently outwardly based, so that when the joint is assembled (when the convex head 134 is received be&.ween the wings 24 and 125) the electrical conductor points 137 and 138, at the upper end of the lower element 131, electrically contact the points 128 and 129, at the lower end of the upper element 121, for electrically communicating the transmission of electricity and, hence, electric power. The lower portion of points 137 and 138 are, in turn, electrically connected with respective power leads (cords 139, 140) which supply electrical power thereto.

The upper and lower elements 121 and 131, respectively, can be combined with shades 101 by mating thread arrangements, by means of screws or by the use of mutual shapes (curving).

Figure 10:
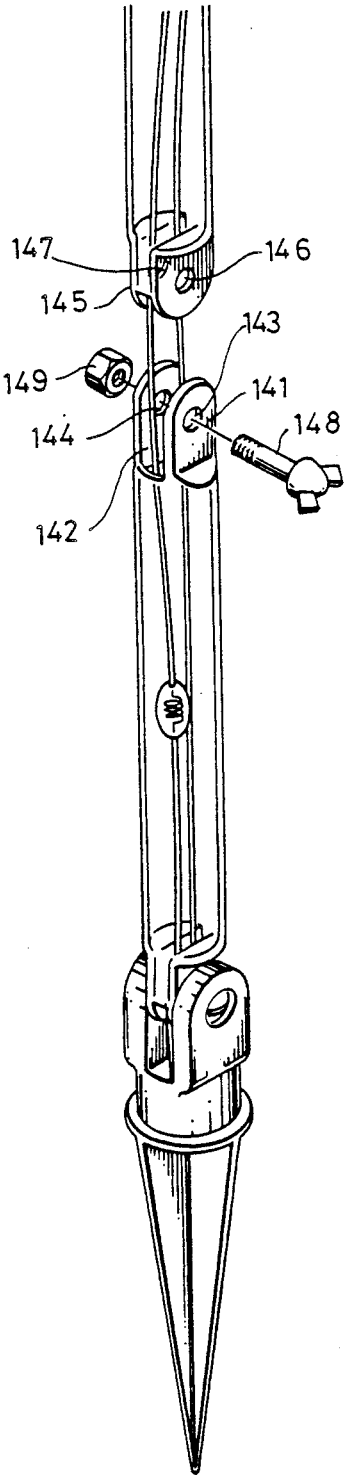
FIG. 10 is a perspective view of the lower end of the another lamp of the present invention with portions of the shade broken away with another embodiment of the joint coupling elements exploded for the sake of clarity.

As shown in FIG. 10, another type of joint is seen. In this embodiment, the upper (top) ends of the shades 101 have a pair of diametrically-opposed upwardly-extending wings 141 and 142 formed thereon. Each of said wings have respective central holes 143 and 144 formed extending therethrough. Each of the central holes 143 and 144 are aligned with one another. The bottom ends of the adjacent shade 101 (located therebelow) has a convex downwardly-extending head 145 formed thereon having a pair of aligned center holes 146 and 146 formed therethrough. When the ends are assembled with the head 145 being received between the wings 141 and 142, the central holes 143, 144, 146, and 147 are all aligned with one another to received therethrough screw 148. Screw 148 has a head and an opposite threaded end and is secured in place by the nut 149. The nut 149 may be selectively tightened and loosened. When loosened, the shades 101 may be pivoted about the screw 148 (and the joint) to a selected position. When tightened, the shades 101 are secured (locked)in place and maintained in the desired position, permitting the selective adjustment of the angles of the shade 101.

If desired, the internal side of the wings 141 and 142, as well as the external side of the head 145 can be fabricated (made into convex-concave threaded or grain shape) in order to increase friction therebetween.

The shades 101 of the present invention can be made so as to have an equi-diameter, straight, tubular, arc, corrogated, or screw shape, depending on what is desired.

Alternately, a non-parallel, non-equi-diameter, circular, polygonal or other geometric shape can be utilized to obtain the desired overall shape, environment or effect of illumination.

If desired, the stake 106 can be found as a part of a poly-connector set, so that multiple sets thereof can be joined together. This permits the length and direction of multiple sets of shades to be varied. This further permits improved illumination effects by choosing a special warning effect.

Based upon the aforesaid descriptions, the low-voltage lamp of the present invention can be situated in the ground of a courtyard for aiding people, during night hours, to see elements and for illuminating and decorating the courtyard.

What is claimed:

1. A low-voltage lamp for illuminating a courtyard, comprising:

at least one transparent heat-resistant shade;

at least one light bulb disposed in each shade;

a stake having a lower end for being inserted into the courtyard and an upper end including an externally-threaded upwardly-extending boss formed thereon;

a coupling element for coupling at least one of the shades to the boss of the stake, such that one of the shades is coupled to and supported by the stake, the coupling element including a top end coupled to the one of the shades and a recessed lower end having internal threads formed therein for removably receiving therein and threadably engaging the externally-threaded boss of the stake, whereby the coupling element is coupled to the stake with the one of the shades coupled to and supported thereby;

electrical conductor points carried by the coupling element extending from the lower end to the top end of the coupling element;

electric circuit wires disposed in the shades and extending from the electrical conduction points at the top end of the coupling element to the light bulbs, whereby the bulbs are electrically connected to the electrical conduction points; and an electrical power cord disposed extending from a low-voltage power source to the electrical conduction points at the lower end of the coupling element, whereby the electrical conduction points are electrically connected to the power source, so that low-voltage electric power is supplied by the power source to the light bulbs for illuminating the bulb and the courtyard in which the stake of the lamp is inserted, further comprised of:

the one of the shades coupled to the coupling element including a lower end having a pair of diametrically-opposed downwardly-extending wings formed thereon, each of said wings having a respective central hole formed therein, the central holes being aligned with one another;

the top end of the coupling element having a pair of diametrically-opposed upwardly extending wings formed thereon, each of said upwardly-extending wings having a respective central hole formed thereon, the central holes being aligned with one another;

such that the wings of the one of the shades are received between the sings of the coupling elements with all of the respective central holes aligned with one another;

a screw having a head and an opposite threaded end, the screw being received through the respective aligned central holes; and a nut for being received on the threaded end of the screw for being selectively tightened and loosened, so that when loosened, the one of the shades may be selectively pivoted about the screw to a selected position, and further so that when tightened, the one of the shades is secured and maintained in the selected position.

2. A low-voltage lamp for illuminating a courtyard, comprising:

at least one transparent heat-resistant shade;

at least one light bulb disposed in each shade;

a stake having a lower end for being inserted into the courtyard and an upper end including an externally-threaded upwardly-extending boss formed thereon;

a coupling element for coupling at least one of the shades to the boss of the stake, such that one of the shades is coupled to and supported by the stake, the coupling element including a top end coupled to the one of the shades and a recessed lower end having internal threads formed therein for removably receiving therein and threadably engaging the externally-threaded boss of the stake, whereby the coupling element is coupled to the stake with the one of the shades coupled to and supported thereby;

electrical conductor points carried by the coupling element extending from the lower end to the top end of the coupling element;

electric circuit wires disposed in the shades and extending from the electrical conduction points at the top of the coupling element to the light bulbs, whereby the bulbs are electrically connected to the electrical conduction points; and an electrical power cord disposed extending from a low-voltage power source to the electrical conduction points at the lower end of the coupling element, whereby the electrical conduction points are electrically connected to the power source, so that low-voltage electric power is supplied by the power source to the light bulbs for illuminating the bulb and the courtyard in which the stake of the lamp is inserted, wherein a plurality of shades are provided, each of said shades having respective internally-threaded top and bottom ends and respective electrical circuit wires and light bulbs disposed therein, and wherein the lamp is further comprised of:

a plurality of joint coupling elements, each of said joint coupling elements including an upper element and a lower element, the upper element having an upper end including an upwardly-extending externally-threaded boss formed thereon for being removably received in and threadably engaged by the threads of the bottom end of a shade located thereabove, the upper element further having a lower end including a pair of diametrically-opposed downwardly-extending wings formed thereon, the wings having a respective central hole formed therein, the central holds being aligned with one another;

electrical conduction points carried by the upper element of the joint coupling elements extending from the upper to the lower ends thereof;

the electrical circuit wires extending from the electrical conduction points at the upper end of the upper element to the light bulb, whereby the bulbs are electrically connected to the electrical conduction points;

the lower element having a lower end including a downwardly-extending externally-threaded boss formed thereon for being removably received in and threadably engaged by the threads of the top end of a shade located therebelow, the lower element further having an upper end including an upwardly-extending convex head formed thereon, the convex head having a central hole formed therethrough, the convex head sized so as to be received between the wings of the upper element with the central holes aligned with one another;

electrical conduction points carried by the lower element extending from the upper to the lower ends thereof, such that when the convex head is received between the wings of the upper element, the electrical conduction points at the upper end of the lower element electrically contact the electrical conduction points at the lower end of the upper element;

electrical circuit wires extending from the electrical conduction points carried by the lower element at the lower end thereof to the power source, whereby electric power can pass through the joint coupling elements;

a plurality of screws having respective heads and opposite threaded ends, each screw being received through the aligned central holes of a respective joint coupling elements; and a nut for being received on each of the threaded ends of the screws for being selectively tightened and loosened, so that when loosened, the shades may be pivoted about the screw to a selected position, and further so that when tightened, the shades are secured and maintained in the selected positions.

3. A low-voltage lamp for illuminating a courtyard, comprising:

at least one transparent heat-resistant shade;

at least one light bulb disposed in each shade;

a stake having a lower end for being inserted into the courtyard and an upper end including an externally-threaded upwardly-extending boss formed thereon;

a coupling element for coupling at least one of the shades to the boss of the stake, such that one of the shades is coupled to and supported by the stake, the coupling element including a top end coupled to the one of the shades and a recessed lower end having internal threads formed therein for removably receiving therein and threadably engaging the externally-threaded boss of the stake, whereby the coupling element is coupled to the stake with the one of the shades coupled to and supported thereby;

electrical conductor points carried by the coupling element extending from the lower end to the top end of the coupling element;

electric circuit wires disposed in the shades and extending from the electrical conduction points at the top end of the coupling element to the light bulbs, whereby the bulbs are electrically connected to the electrical conduction points; and an electrical power cord disposed extending from a low-voltage power source to the electrical conduction points at the lower end of the coupling element, whereby the electrical conduction points are electrically connected to the power source, so that low-voltage electric power is supplied by the power source to the light bulbs for illuminating the bulb and the courtyard in which the stake of the lamp is inserted, wherein a plurality of shades are provided, each of said shades having respective top and bottom ends, and wherein the lamp is further comprised of:

the top ends of the shades having a pair of diametrically-opposed upwardly-extending wings formed thereon, each of said wings having a respective central hole formed therein, each of the central holes being aligned with one another;

the bottom ends of the shades having a convex downwardly-extending head formed thereon having a central hole formed therethrough, such that the head may be received between the wings of the top ends of the shades with the central holes aligned with one another;

a plurality of screw having respective heads and opposite threaded ends, each screw being received through the aligned central holes of the wings and the head; and a nut for being received on each of the threaded ends of the screws for being selectively tightened and loosened, so that when loosened, the shades may be pivoted about the screw to a selected position, and further so that when tightened, the shades are secured and maintained in the selected positions.

* * * * *